US011771296B1

(12) United States Patent
Boldt

(10) Patent No.: US 11,771,296 B1
(45) Date of Patent: Oct. 3, 2023

(54) CLEANING DEVICE

(71) Applicant: Allen Norman Boldt, Kirkwood, MO (US)

(72) Inventor: Allen Norman Boldt, Kirkwood, MO (US)

( * ) Notice: Subject to any disclaimer, the term of this patent is extended or adjusted under 35 U.S.C. 154(b) by 0 days.

(21) Appl. No.: 17/861,668

(22) Filed: Jul. 11, 2022

(51) Int. Cl.

| | |
|---|---|
| ***A47L 13/16*** | (2006.01) |
| ***A47L 13/17*** | (2006.01) |
| ***A46B 7/04*** | (2006.01) |
| ***A46B 11/06*** | (2006.01) |

(52) U.S. Cl.
CPC ..... *A47L 13/16* (2013.01); *A46B 7/04* (2013.01); *A46B 11/063* (2013.01); *A47L 13/17* (2013.01)

(58) Field of Classification Search
CPC ..... A47L 13/16; A47L 13/17; A47L 13/18; A47L 13/19; A47L 13/23; A46B 7/04; A46B 11/063; A46B 11/06; A46B 11/066
USPC ..... 401/203, 204, 207, 289
See application file for complete search history.

(56) References Cited

U.S. PATENT DOCUMENTS

| | | | | | |
|---|---|---|---|---|---|
| 2,904,809 | A * | 9/1959 | Clayson | A47L 17/00 | 401/136 |
| 2,940,103 | A * | 6/1960 | Czapar | A47L 1/08 | 401/203 |
| 3,070,826 | A * | 1/1963 | Paterno | A47L 13/23 | 251/149.4 |
| 3,359,591 | A * | 12/1967 | McGuire | A47L 13/23 | 15/210.1 |
| 4,618,279 | A * | 10/1986 | Gurevich | A47L 17/00 | 401/23 |
| 4,859,102 | A * | 8/1989 | Chamieh | A46B 11/063 | 401/136 |

* cited by examiner

*Primary Examiner* — David J Walczak
(74) *Attorney, Agent, or Firm* — Burris Law, PLLC

(57) ABSTRACT

A cleaning device includes a porous body and a dispensing reservoir disposed within the porous body. The dispensing reservoir has at least one opening being disposed at a predetermined location along a length of the dispensing reservoir such that a rate at which the solution flows into the porous body varies based specific orientations of the porous body. A perforated fluid supply conduit is also disposed within the porous body and extends alongside the dispensing reservoir, the perforated fluid conduit having a plurality of perforations. The dispensing reservoir and the perforated fluid supply conduit are not directly fluidly coupled.

20 Claims, 10 Drawing Sheets

CLEANING DEVICE

FIELD

The present disclosure relates to washing vehicles, and more particularly to equipment and accessories for use in washing vehicles using a standard garden hose.

BACKGROUND

The statements in this section merely provide background information related to the present disclosure and may not constitute prior art.

Car enthusiasts find themselves washing their vehicles frequently, especially in geographic areas where snow, dirt, and debris tend to accumulate in the winter months. Many car washing implements and methods are used, and debated, throughout the user community.

Some users recommend wetting a vehicle with water before applying a cleaning solution, such as diluted liquid soap, in order to remove as much dirt and residue as possible before applying a sponge or other cleaning implement containing the cleaning solution. If the dirt and residue remain on the surface of the vehicle when a soapy sponge is used to wipe off the dirt and residue, there is a possibility that the paint/coating could be scratched or damaged from the abrasive action. Further, some water supplies have a relatively high particle count and thus filtering devices are often used to remove a majority of these particles before the water reaches the surface of the vehicle. However, these filtering devices can be expensive, and removing the dirt and residue before washing a vehicle can consume large quantities of water.

These issues related to the efficiency and effectiveness of vehicle washing are addressed by the present disclosure.

SUMMARY

This section provides a general summary of the disclosure and is not a comprehensive disclosure of its full scope or all of its features.

In one form of the present disclosure, a cleaning device comprises a porous body, a dispensing reservoir disposed within the porous body, the dispensing reservoir comprising an internal cavity configured to hold a solution, a proximal end portion, a distal end portion, and a sidewall extending between the proximal end portion and the distal end portion, the dispensing reservoir further comprising at least one opening extending through the sidewall and into the internal cavity, the at least one opening being disposed at a predetermined location along a length of the dispensing reservoir such that a rate at which the solution flows into the porous body varies based specific orientations of the porous body, and a perforated fluid supply conduit disposed within the porous body and extending alongside the dispensing reservoir, the perforated fluid conduit comprising a proximal end portion, a distal end portion, and a plurality of perforations. The dispensing reservoir and the perforated fluid supply conduit are not directly fluidly coupled.

In variations of this form, which may be implemented individually or in any combination: a fitting is secured to the distal end portions of the dispensing reservoir and the perforated fluid supply conduit; the porous body comprises a distal end slot configured to remove and install the dispensing reservoir, perforated fluid supply conduit, and the fitting, a fluid coupler is secured to the proximal end portion of the perforated fluid supply conduit, the fluid coupler adapted to secure a fluid supply line to the perforated fluid supply conduit; the fluid coupler comprises a connection assembly including an adapter, male and female quick connects, and a water valve; the porous body is a synthetic sponge; a refill cap is removably secured to a proximal end portion of the dispensing reservoir; the plurality of perforations of the perforated fluid supply conduit are radially opposed and are directed towards the dispensing reservoir and towards an exterior surface of the porous body; the plurality of perforations of the perforated fluid supply conduit are located at the distal end portion of the perforated fluid supply conduit; the at least one opening of the dispensing reservoir is disposed at the proximal end portion of the dispensing reservoir; the dispensing reservoir comprises two radially opposed openings disposed at the proximal end portion of the dispensing reservoir; the porous body comprises a material having a debris-contrasting color; at least one accessory is secured to the porous body; the accessory is selected from the group consisting of bristles and a cover; the porous body comprises a monolithic material; and the porous body comprises two different materials separated along a longitudinal interface of the porous body.

In another form of the present disclosure, a cleaning device comprises a porous body, a dispensing reservoir disposed within the porous body, the dispensing reservoir comprising an internal cavity configured to hold a solution, a proximal end portion, a distal end portion, and a sidewall extending between the proximal end portion and the distal end portion, the dispensing reservoir further comprising at least one opening extending through the sidewall and into the internal cavity, a perforated fluid supply conduit disposed within the porous body and extending alongside the dispensing reservoir, the perforated fluid conduit comprising a proximal end portion, a distal end portion, and a plurality of perforations, and a fitting secured to the distal end portions of the dispensing reservoir and the fluid conduit. The dispensing reservoir and the perforated fluid supply conduit are not directly fluidly coupled.

In variations of this form, which may be implemented individually or in any combination: the at least one opening is disposed at a predetermined location along a length of the dispensing reservoir such that the solution flows into the porous body only at specific orientations of the porous body; and a connection assembly includes an adapter, male and female quick connects, and a water valve removably connected a proximal end portion of the perforated fluid supply conduit.

In yet another form of the present disclosure, a cleaning device comprises a porous body, a dispensing reservoir disposed within the porous body, the dispensing reservoir comprising an internal cavity configured to hold a solution, a proximal end portion, a distal end portion, and a sidewall extending between the proximal end portion and the distal end portion, the dispensing reservoir further comprising at least one opening extending through the sidewall and into the internal cavity, the at least one opening being disposed at a predetermined location along a length of the dispensing reservoir such that the solution flows into the porous body only at specific orientations of the porous body, and a perforated fluid supply conduit disposed within the porous body and extending alongside the dispensing reservoir, the perforated fluid conduit comprising a proximal end portion, a distal end portion, and a plurality of perforations. The dispensing reservoir and the perforated fluid supply conduit are not directly fluidly coupled.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 1 is a perspective view of a cleaning device constructed according to the present disclosure;

FIG. 2 an exploded view of the cleaning device of FIG. 1;

Figure 1:
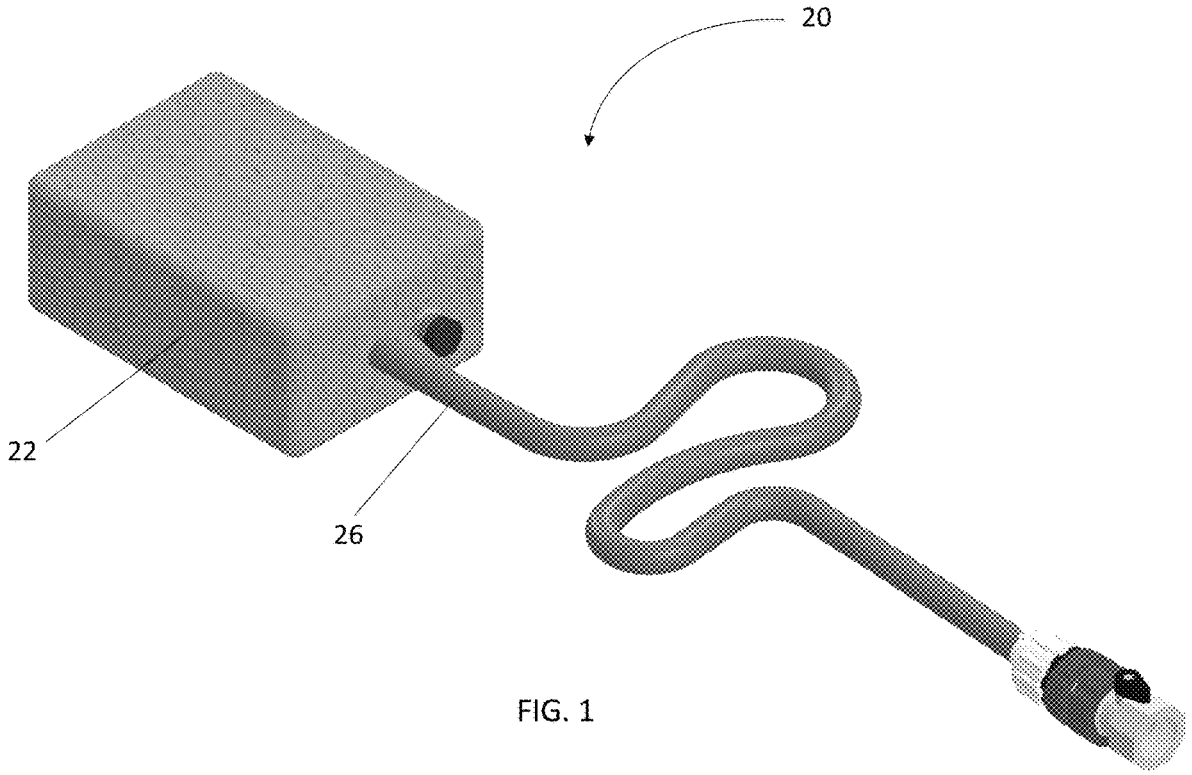

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 2:
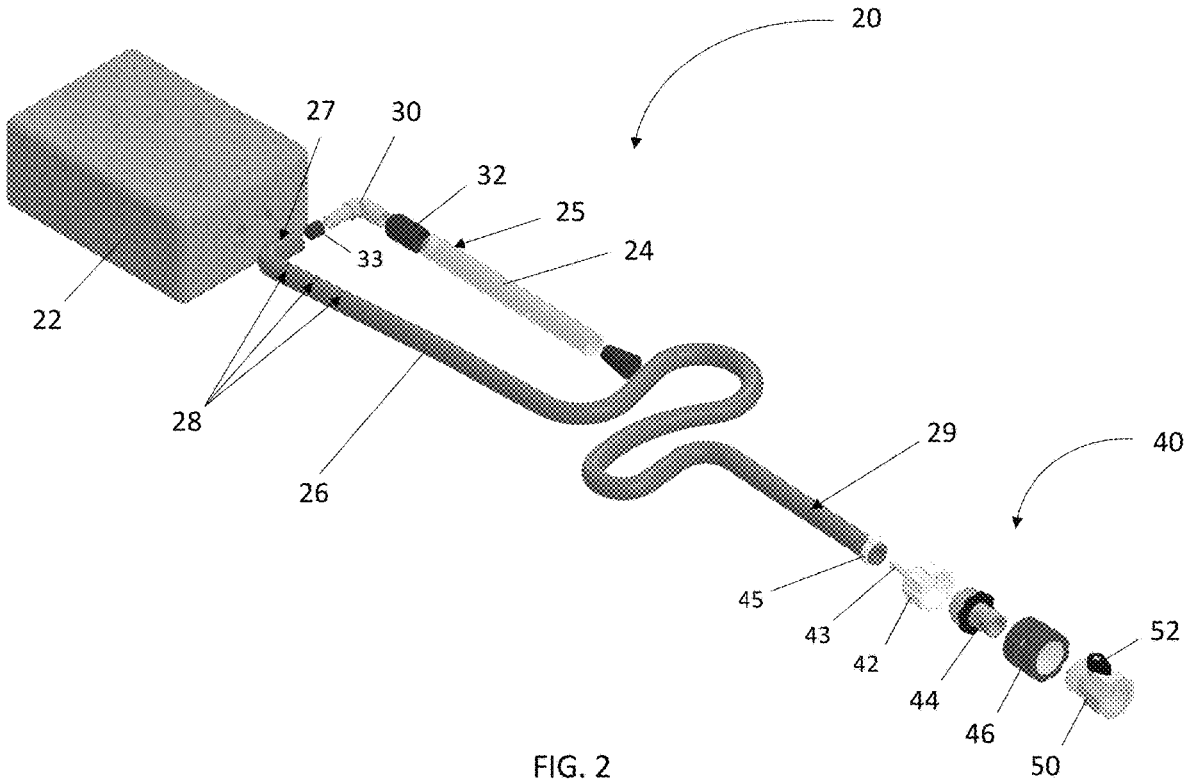

With reference to FIGS. 1 and 2, a cleaning device according to the teachings of the present disclosure is illustrated and generally indicated by reference numeral 20. The cleaning device 20 includes a porous body 22, which in one form is a synthetic sponge of any desirable material, porosity, and color, as discussed in greater detail below. A dispensing reservoir 24 is disposed within the porous body 22 and generally functions to hold and dispense a solution, such as liquid soap for washing a vehicle. A perforated fluid supply conduit 26 is also disposed within the porous body 22 and extends alongside the dispensing reservoir 24 as shown. The perforated fluid supply conduit 26 comprises a plurality of perforations or openings 28 as shown, which can be specifically arranged according to specific use requirements as described in greater detail below.

The dispensing reservoir 24 and the perforated fluid supply conduit 26 are connected at their distal end portions 25 and 27, respectively, by an optional fitting 30. In this form, the dispensing reservoir 24 is connected to the fitting 30 with shrink-fit collar 32. A cap 33 extends over an end of the fitting 30 as shown so as to block the flow of water between the perforated fluid supply conduit 26 and the dispensing reservoir 24. Importantly, the dispensing reservoir 24 and the perforated fluid supply conduit 26 are not in fluid communication, which is described in greater detail below. The perforated fluid supply conduit 26, which in one form is a flexible elastomeric material, then slides over the cap 33 and the end of the fitting 30 and is secured thereto with an interference fit. Optionally, an adhesive may be provided at this interface to improve the connection between the perforated fluid supply conduit 26 and the fitting 30. It should be understood, however, that the dispensing reservoir 24 and the perforated fluid supply conduit 26 could be connected to the fitting 30, or directly to each other, by other means, including by way of example mechanical threads, adhesive, and/or welding, among others, while remaining within the scope of the present disclosure. In another form illustrated and described below, the dispensing reservoir 24 and the perforated fluid supply conduit 26 are provided as a single unitized piece.

Importantly, the dispensing reservoir 24 and the perforated fluid supply conduit 26 are not directly fluidly coupled and thus the fitting 30 is used in this form to locate and secure the dispensing reservoir 24 and the perforated fluid supply conduit 26 within the porous body 22. As used herein, the phrase "not directly fluidly coupled" should be construed to mean that fluid flowing through the inside of the perforated fluid supply conduit 26 is not fluidly coupled to, or does not flow from the inside of the perforated fluid supply conduit 26 to the inside of the dispensing reservoir 24. Instead, the fitting 30 is either a solid body, or a hollow body with its ends capped off such that fluid flowing through the inside of the perforated fluid supply conduit 26 is blocked from flowing any further by the fitting 30 and is forced to flow out of the perforations 28. In other words, the fitting 30 functions as a fluid dam. It should be understood, however, that the fitting 30 is optional and another variation to accomplish the fluid dam may be to cap off the distal end portion 27 of the perforated fluid supply conduit 26. These and other variations to block the fluid from directly flowing from the inside of the perforated fluid supply conduit 26 to the inside of the dispensing reservoir 24 should be construed as falling within the scope of the present disclosure.

As further shown, a fluid coupler, which in this form is a connection assembly 40, is secured to the proximal end portion 29 of the perforated fluid supply conduit 26. The connection assembly 40 is adapted to secure a fluid supply line, such as by way of example a garden hose (not shown), to the perforated fluid supply conduit 26. The connection assembly 40 in this form includes an adapter 42, male quick connect 44 and a female quick connect 46. The adapter 42 includes a corrugated extension 43 that extends into the proximal end portion 29 of the perforated fluid supply conduit 26. The adapter 42 is then further secured to the perforated fluid supply conduit 26 with a hose clamp 45. The adapter 42 is internally threaded to receive the external threads of the male quick connect 44. A water valve 50 is also provided in this form of the present disclosure, which includes a flow throttle lever 52 for ease of changing the rate of flow of the fluid (e.g., water) supply, including on and off, by the user. The water valve 50 is removably connected to the connection assembly 40, and it should be understood that the water valve 50 may be implemented with or without the connection assembly 40 while remaining within the scope of the present disclosure.

Figure 3A:
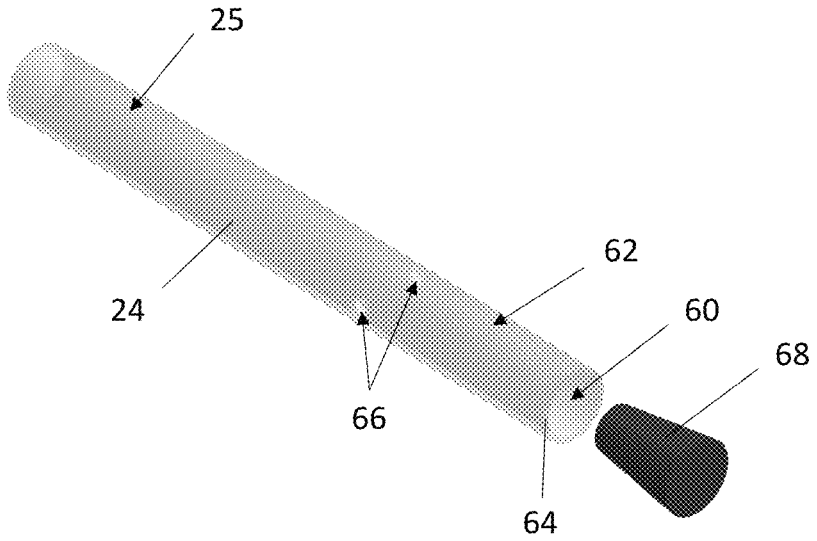
FIG. 3A is an exploded perspective view of a dispensing reservoir and a refill cap of the cleaning device according to the teachings of the present disclosure.
Figure 3B:
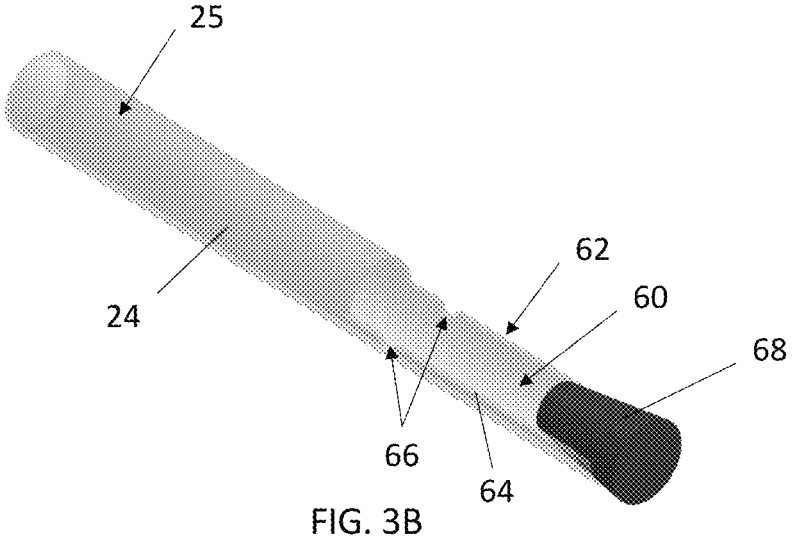
FIG. 3B is a partial cutaway perspective view of the dispensing reservoir of FIG. 3A.

Referring now to FIGS. 3A-3B, the dispensing reservoir 24 comprises an internal cavity 60 that is configured to hold the solution, along with a proximal end portion 62, the distal end portion 25, and a sidewall 64 extending between the proximal end portion 62 and the distal end portion 25. The dispensing reservoir 24 further comprises at least one opening 66 extending through the sidewall 64 and into the internal cavity 60, which is disposed at a predetermined location along a length of the dispensing reservoir 24 such that the dispensing rate into the porous body 22 is dependent on and varies according to the orientation of the cleaning device 20 during use. Examples of these orientations are described in greater detail below. And while the dispensing reservoir 24 is illustrated as a tubular body, it should be understood that other shapes/geometries for a reservoir, such as by way of example a curved pouch, may be employed while remaining within the scope of the present disclosure. Further, while the dispensing reservoir 24 is illustrated and described as being fixed in place, it should be understood that the dispensing reservoir 24 could be rotatable, adjusted, or interchangeable to reposition or reconfigure the openings 66 according to user requirements.

In this form, the dispensing reservoir 24 further includes a refill cap 68 removably secured to the proximal end portion 62. The refill cap 68 in this form is a tapered plug as shown and is a rubber material. However, other forms of the refill cap 68 may include a threaded cap or other mechanical means to close off the open proximal end portion 62 of the dispensing reservoir 24. The refill cap 68 thus allows the user to easily refill the dispensing reservoir 24 as needed.

Figure 4A:
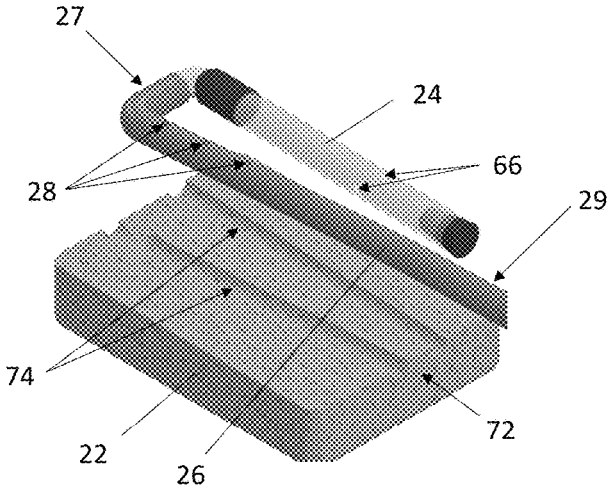
FIG. 4A is an exploded partial perspective view of the cleaning device of FIG. 1.
Figure 4B:
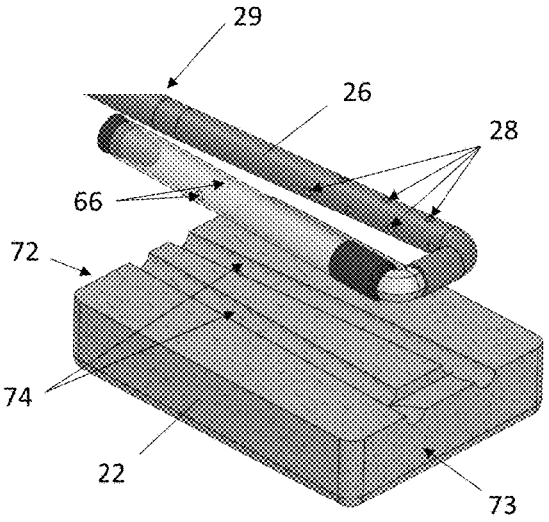
FIG. 4B is another exploded partial perspective view of the cleaning device of FIG. 1.

Referring to FIGS. 4A and 4B, the perforated fluid supply conduit 26 comprises a proximal end portion 29, a distal end portion 27, and a plurality of perforations 28. In this form, the perforated fluid supply conduit 26 is a single piece that extends into the porous body 22 as shown. Alternately, the perforated fluid supply conduit 26 may be connected to an adapter hose (not shown) which may be integral with the perforated fluid supply conduit 26 or a separate piece. The extended adapter hose is configured to secure a fluid supply line (e.g., a garden hose) to the perforated fluid supply conduit 26.

In one form, the plurality of perforations 28 of the perforated fluid supply conduit 26 are directed towards the dispensing reservoir 24 and towards an outer surface of the porous body 22 as shown. Also in this form, the plurality of perforations 28 of the perforated fluid supply conduit 26 are located at the distal end portion 27 of the perforated fluid supply conduit 26. It should be understood, however, that any number, configuration, and location of perforations 28 may be employed while remaining within the scope of the present disclosure.

As further shown, the dispensing reservoir 24 includes two (2) openings 66 in this variation of the present disclosure, which are radially opposed. One opening 66 is oriented towards the perforated fluid supply conduit 26, and the other opening 66 is oriented towards an exterior side surface of the porous body 22. It should be understood, however, that any number and orientations of the openings 66 may be employed while remaining within the scope of the present disclosure. For example, one opening 66 of the dispensing reservoir may be oriented normal (not shown) to one of the upper or lower surfaces of the porous body 22.

The porous body 22 also includes internal cavities 74, which are configured to locate and hold the dispensing reservoir 24 and the perforated fluid supply conduit 26 in place. In this form, the cavities 74 taper inwardly near a proximal end portion 72 of the porous body 22. The cavities 74 taper inwardly so as to center the proximal end of the dispensing reservoir 24 and the perforated fluid supply conduit 26 at the proximal end of the porous body 22, and the cavities 74 are wider or further apart at a distal end portion 73 to provide space for the internal components and also for strain relief.

Figure 5A:
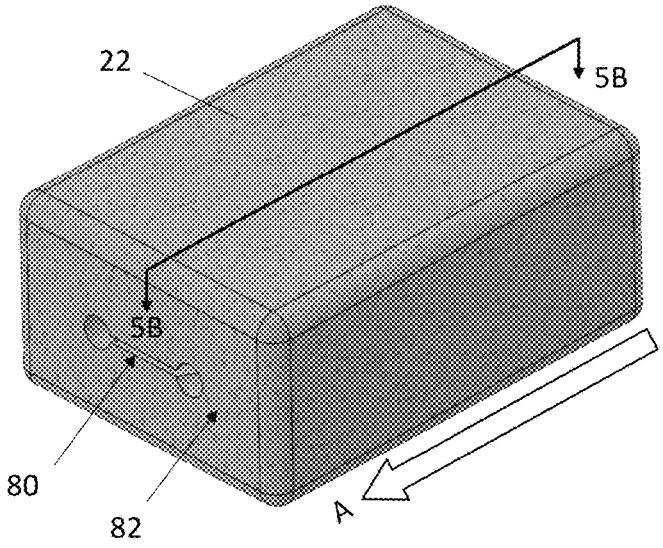
FIG. 5A is a perspective view of a porous body of the cleaning device according to the present disclosure.
Figure 5B:
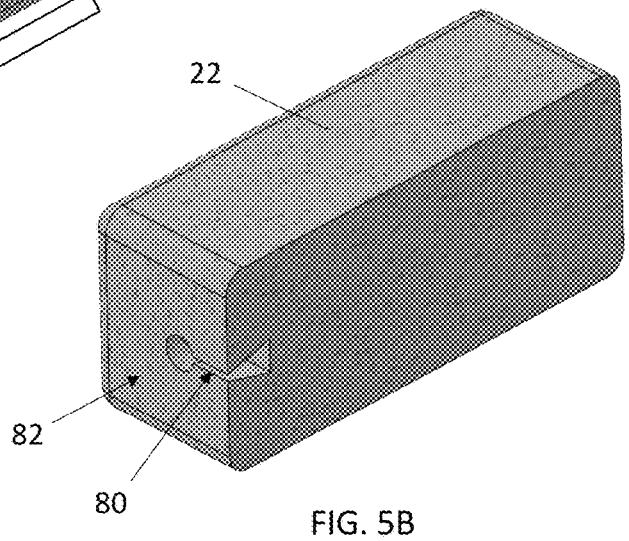
FIG. 5B is a perspective cross-sectional view of the porous body of FIG. 5A, taken along line 5B—5B, illustrating a tapered cavity at a distal end portion.

Referring to FIGS. 5A and 5B, the porous body 22 further comprises a distal end slot 80 configured to remove the dispensing reservoir 24, perforated fluid supply conduit 26, and the optional fitting 30. The distal end slot 80 extends through an exterior end surface 82 of the porous body 22 such that the dispensing reservoir 24, the perforated fluid supply conduit 26, and the optional fitting 30 can be pulled through the porous body 22 in the direction of arrow A. When the porous body 22 becomes worn and needs replacement, the reusable components of the cleaning device, namely, the dispensing reservoir 24, the perforated fluid supply conduit 26, and the optional fitting 30, can be removed and installed into a new, replacement porous body 22.

In one form, the distal end slot 80 tapers inwardly towards the exterior end surface 82, in a "dovetail" configuration, in order to better secure the perforated fluid supply conduit 26 and the optional fitting 30 in place during use. It should be understood that this geometrical configuration for the distal end slot 80 is merely exemplary, and other configurations may be employed while remaining within the scope of the present disclosure.

The porous body 22 in one form comprises a material having a debris-contrasting color. For example, the porous body 22 may be yellow or light blue, to contrast dark debris such as dirt or oil/grease. The porous body 22 as shown herein is a single body made of the same, or a monolithic material. However, other variations of the porous body 22 as illustrated and described in greater detail below may also be employed while remaining within the scope of the present disclosure.

Figure 6A:
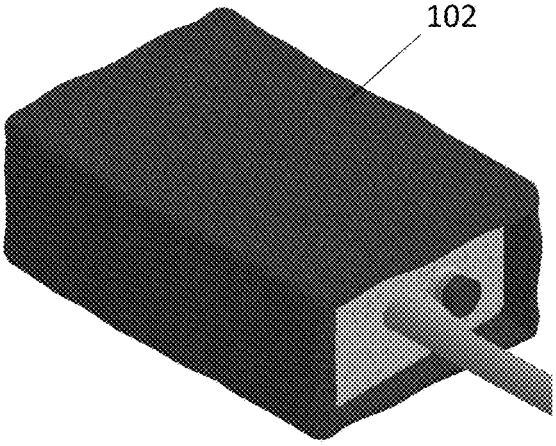
FIG. 6A is a perspective view of an accessory, namely, a cover, secured to the porous body and constructed in accordance with the teaching of the present disclosure.
Figure 6B:
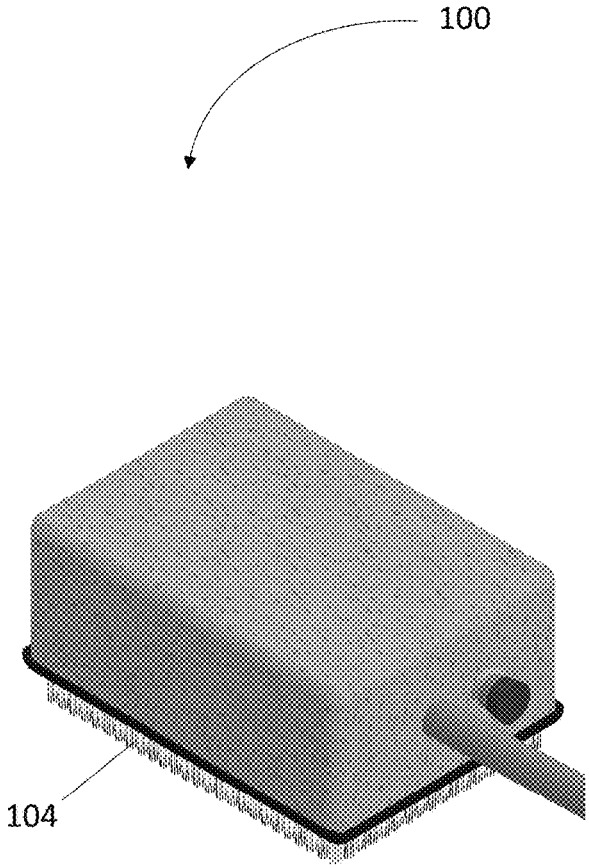
FIG. 6B is a perspective view of another accessory, namely, a brush, secured to the porous body and constructed in accordance with the teaching of the present disclosure.
Figure 7:
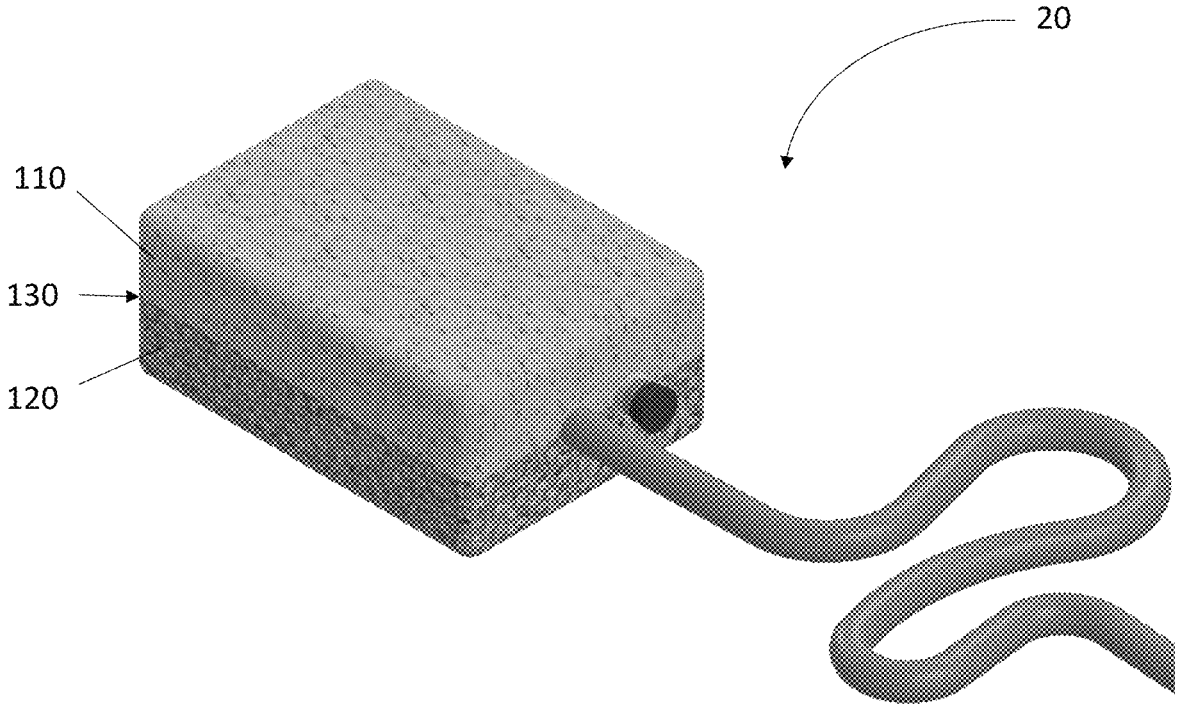
FIG. 7 is a perspective view of another form of a porous body of the cleaning device according to the present disclosure.

Referring now to FIGS. 6A-6B and 7, the cleaning device 20 in one form comprises a variety of accessories 100 that are secured to the porous body 22 for specific cleaning tasks. For example, the accessory 100 in one form is a cover 102, which may be a microfiber material by way of example. In another form, the accessory 100 is a brush/bristles 104. These and other accessories may be employed with the cleaning device 20 while remaining within the scope of the present disclosure.

Referring to FIG. 7, in another form of the present disclosure, the porous body 22 comprises two different materials 110 and 120, which are separated along a longitudinal interface 130 of the porous body 22. In this variation, one material 110 may be a softer material for specific surfaces or levels of debris, while the other material 120 is a more abrasive material for other surfaces such as tires by way of example. The two different materials 110 and 120 may be joined with an adhesive material (not shown) or otherwise secured to each other with permanent or removable fastening means.

Figure 8:
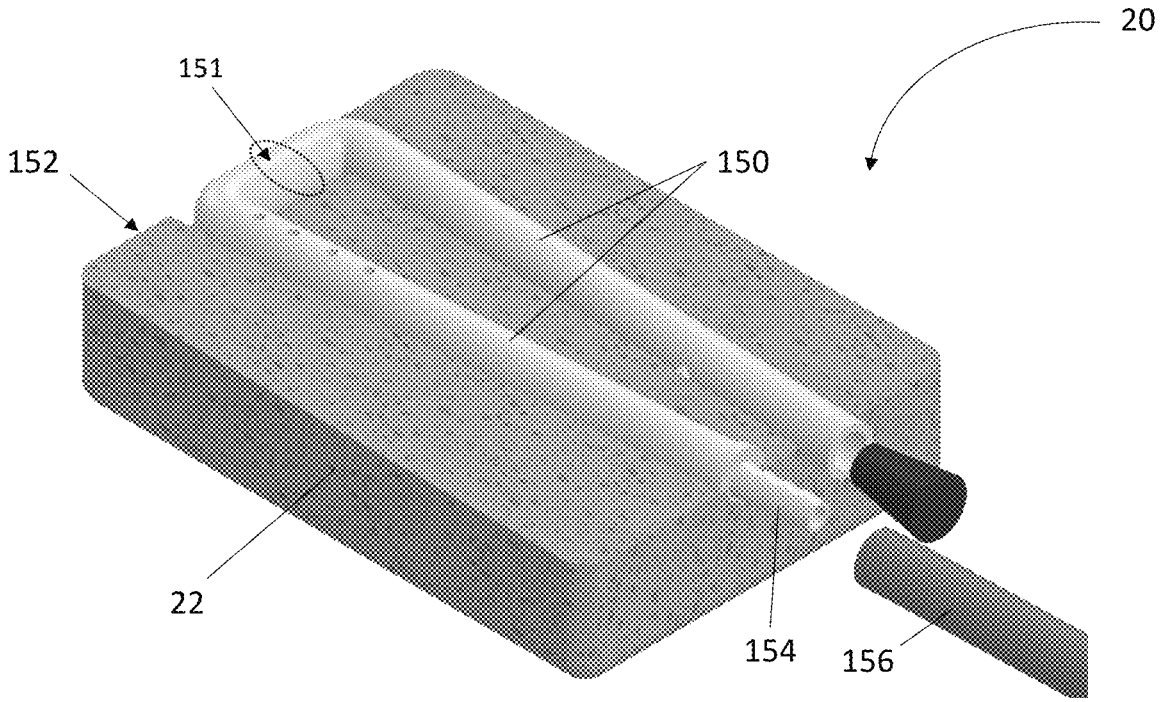
FIG. 8 is a partial cutaway perspective view of another form of the cleaning device constructed according to the teachings of the present disclosure.

With reference to FIG. 8, another form of the cleaning device 20 is illustrated, wherein the perforated fluid supply conduit 26 and the dispensing reservoir 24 are configured as a single unitized component 150. In this form, a distal end portion 152 of the unitized component 150 is solid such that the perforated fluid supply conduit 26 and the dispensing reservoir 24 are not directly fluidly coupled. For example, the region 151 may be solid to provide a barrier to fluid flow. Further, the perforated unitized component 150 includes a barbed end portion 154 for connecting a fluid supply line 156. However, it should be understood that any type of coupling device or connection may be employed to secure the fluid supply line 156 to the unitized component 150, such as by way of example, a threaded connection with rotating collar as used in many garden hoses.

In yet another form, the porous body 22 may be molded around the internal components, i.e., the dispensing reservoir 24 and the perforated fluid supply conduit 26, and any other optional fittings as illustrated and described above. Various components, such as by way of example, fitting 30, shrink-fit collar 32, and cap 33, among others, may be eliminated and/or combined into fewer parts for the overall cleaning device 20. Further, 3D printing, or additive manufacturing, techniques may be employed to build some or all of the cleaning device 20 and its various accessories/components while remaining within the scope of the present disclosure.

Figure 9:
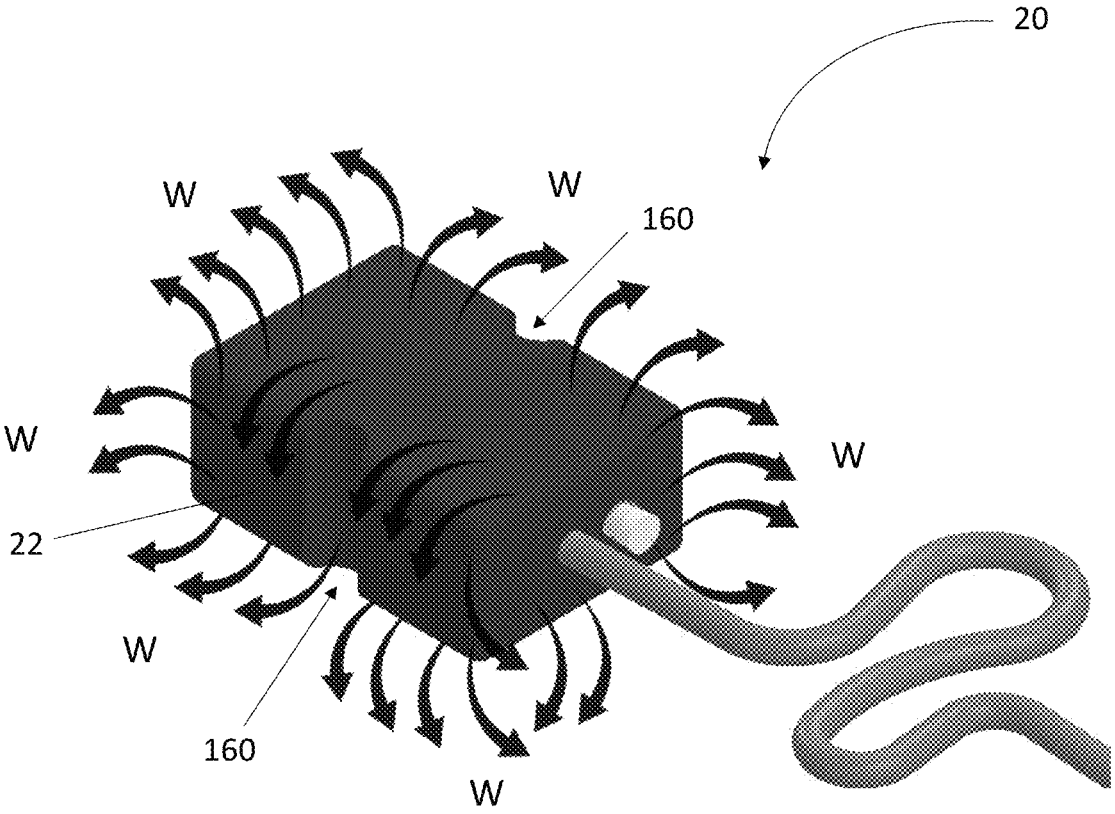
FIG. 9 is a perspective view of the cleaning device illustrating a flow of water mixed with a cleaning solution, during operation/use of the cleaning device according to the teachings of the present disclosure.

Now referring to FIG. 9, the cleaning device 20 is illustrated in operation with a flow of water "W" (or other cleaning fluid) being supplied through the perforated fluid supply conduit 26, mixed with a cleaning solution supplied through the dispensing reservoir 24, continuously flowing out through the exterior surfaces of the porous body 22. With the innovative and strategic arrangement of the opening(s) 66 in the dispensing reservoir 24 and the perforations 28 in the perforated fluid supply conduit 26, a continuous supply of water W and cleaning solution is being supplied so as to more effectively and efficiently remove debris during cleaning/washing. This continuous supply of water W and strategic location of the perforations 28 functions to both pull the cleaning solution from the dispensing reservoir 24 as well as provide a flow of water and cleaning solution to an exterior of the porous body 22. Accordingly, a vehicle or any other object can be quickly and effectively cleaned/washed with the cleaning device 20 according to the teachings herein.

As further shown in FIG. 9, the porous body 22 may come in a variety of shapes, configurations, and colors. In this example, the debris-contrasting color is blue as compared with the yellow or light beige color illustrated in the other figures. Further, the porous body 22 may have other features such as cutouts 160 in the side portions for better gripping by a user. These features, such as the cutouts 160 illustrated herein, will also dictate the location of the internal cavities 74 of the porous body 22 as well as the layout of the perforated fluid supply conduit 26 and the dispensing reservoir 24. These and other variations of the porous body 22 should be construed as falling within the scope of the present disclosure.

Figure 10A:
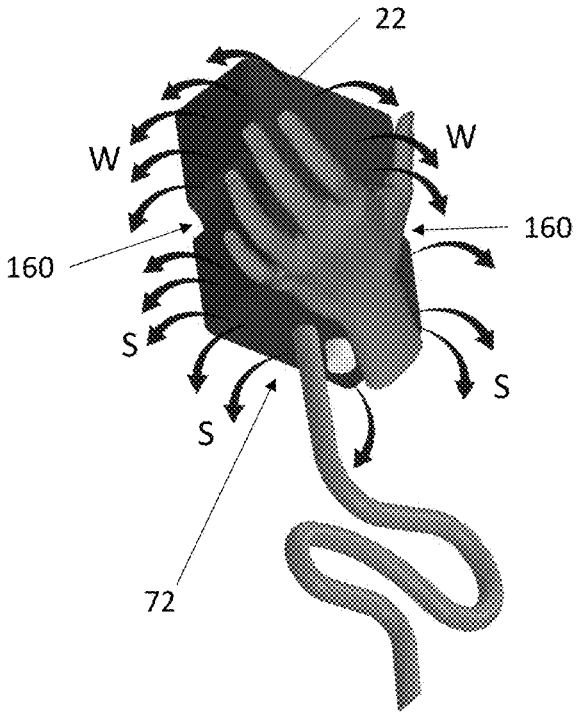
FIG. 10A is a perspective view of the cleaning device being held in an upright position during use.
Figure 10B:
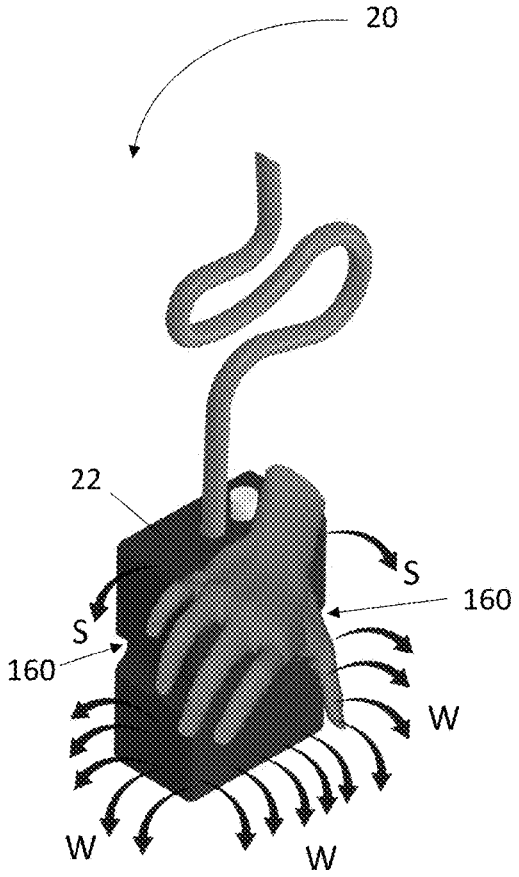
FIG. 10B is a perspective view of the cleaning device being held in a downright position during use.

Referring now to FIGS. 10A and 10B, the various dispensing directions/rates of cleaning solution and fluid flow are illustrated, which are based on the orientation of the cleaning device 20 during use, as well as the number, size, and orientation of the openings 66 and perforations 28 (FIGS. 4A-4B). The flow of water is shown with arrows "W" and the flow of solution is shown with arrows "S." When the cleaning device 20 is in an upright position as shown in FIG. 10A, the water flows down from the top and the solution flows out from the proximal end portion 72 of the porous body 22. When the cleaning device 20 is in a downright position as shown in FIG. 10B, the water flows down as shown and the solution follows down over/with the water based on the position and orientation of the openings 66 and perforations 28. It should be understood that these dispensing directions/rates are based on the orientations as illustrated and described herein, and thus with different numbers, sizes, and orientations of the openings 66 and perforations 28, the flow of water "W" and flow of solution "S" may be tailored for a specific application.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A cleaning device comprising:

a porous body;

a dispensing reservoir disposed within the porous body, the dispensing reservoir comprising an internal cavity configured to hold a solution, a proximal end portion, a distal end portion, and a sidewall extending between the proximal end portion and the distal end portion, the dispensing reservoir further comprising at least one opening extending through the sidewall and into the internal cavity, the at least one opening being disposed at a predetermined location along a length of the dispensing reservoir such that a rate at which the solution flows into the porous body varies based on specific orientations of the porous body; and a perforated fluid supply conduit disposed within the porous body and extending alongside and outside of the dispensing reservoir such that a portion of the porous body is disposed between the dispensing reservoir and the perforated fluid supply conduit, the perforated fluid supply conduit comprising a proximal end portion, a distal end portion, and a plurality of perforations, wherein the dispensing reservoir and the perforated fluid supply conduit are not directly fluidly coupled.

2. The cleaning device according to claim 1, further comprising a fitting secured to the distal end portions of the dispensing reservoir and the perforated fluid supply conduit.

3. The cleaning device according to claim 2, wherein the porous body comprises a distal end slot configured to remove and install the dispensing reservoir, perforated fluid supply conduit, and the fitting.

4. The cleaning device according to claim 1, further comprising a fluid coupler secured to the proximal end portion of the perforated fluid supply conduit, the fluid coupler adapted to secure a fluid supply line to the perforated fluid supply conduit.

5. The cleaning device according to claim 4, wherein the fluid coupler comprises a connection assembly including an adapter, male and female quick connects, and a water valve.

6. The cleaning device according to claim 1, wherein the porous body is a synthetic sponge.

7. The cleaning device according to claim 1, further comprising a refill cap removably secured to the proximal end portion of the dispensing reservoir.

8. The cleaning device according to claim 1, wherein the plurality of perforations of the perforated fluid supply conduit are radially opposed and are directed towards the dispensing reservoir and towards an exterior surface of the porous body.

9. The cleaning device according to claim 1, wherein the plurality of perforations of the perforated fluid supply conduit are located at the distal end portion of the perforated fluid supply conduit.

10. The cleaning device according to claim 1, wherein the at least one opening of the dispensing reservoir is disposed at the proximal end portion of the dispensing reservoir.

11. The cleaning device according to claim 10, wherein the dispensing reservoir comprises two radially opposed openings disposed at the proximal end portion of the dispensing reservoir.

12. The cleaning device according to claim 1, wherein the porous body comprises a material having a debris-contrasting color.

13. The cleaning device according to claim 1, further comprising at least one accessory secured to the porous body.

14. The cleaning device according to claim 13, wherein the accessory is selected from the group consisting of bristles and a cover.

15. The cleaning device according to claim 1, wherein the porous body comprises a monolithic material.

16. The cleaning device according to claim 1, wherein the porous body comprises two different materials separated along a longitudinal interface of the porous body.

17. A cleaning device comprising:

a porous body;

a dispensing reservoir disposed within the porous body, the dispensing reservoir comprising an internal cavity configured to hold a solution, a proximal end portion, a distal end portion, and a sidewall extending between the proximal end portion and the distal end portion, the dispensing reservoir further comprising at least one opening extending through the sidewall and into the internal cavity;

a perforated fluid supply conduit disposed within the porous body and extending alongside the dispensing reservoir, the perforated fluid supply conduit comprising a proximal end portion, a distal end portion, and a plurality of perforations; and a fitting secured to the distal end portions of the dispensing reservoir and the fluid conduit, wherein the dispensing reservoir and the perforated fluid supply conduit are not directly fluidly coupled.

18. The cleaning device according to claim 17, wherein the at least one opening is disposed at a predetermined location along a length of the dispensing reservoir such that the solution flows into the porous body only at specific orientations of the porous body.

19. The cleaning device according to claim 17, further comprising a connection assembly including an adapter, male and female quick connects, and a water valve removably connected a proximal end portion of the perforated fluid supply conduit.

20. A cleaning device comprising:

a porous body;

a dispensing reservoir disposed within the porous body, the dispensing reservoir comprising an internal cavity configured to hold a solution, a proximal end portion, a distal end portion, and a sidewall extending between the proximal end portion and the distal end portion, the dispensing reservoir further comprising at least one opening extending through the sidewall and into the internal cavity, the at least one opening being disposed at a predetermined location along a length of the dispensing reservoir such that the solution flows into the porous body only at specific orientations of the porous body; and a perforated fluid supply conduit disposed within the porous body and extending alongside and outside of the dispensing reservoir such that a portion of the porous body is disposed between the dispensing reservoir and the perforated fluid supply conduit, the perforated fluid supply conduit comprising a proximal end portion, a distal end portion, and a plurality of perforations, wherein the dispensing reservoir and the perforated fluid supply conduit are not directly fluidly coupled.

* * * * *